US010514641B1

(12) United States Patent
Kitajima

(10) Patent No.: US 10,514,641 B1
(45) Date of Patent: Dec. 24, 2019

(54) IMAGE FORMING APPARATUS AND CONTROL METHOD OF IMAGE FORMING APPARATUS

(71) Applicant: TOSHIBA TEC KABUSHIKI KAISHA, Shinagawa-ku, Tokyo (JP)

(72) Inventor: Tatsuya Kitajima, Kawasaki Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/157,864

(22) Filed: Oct. 11, 2018

(51) Int. Cl.
*G03G 15/00* (2006.01)
*G03G 15/095* (2006.01)

(52) U.S. Cl.
CPC ..... *G03G 15/50* (2013.01); *G03G 15/095* (2013.01)

(58) Field of Classification Search
CPC ... G03G 15/50; G03G 15/095; G03G 15/5045
See application file for complete search history.

(56) References Cited

U.S. PATENT DOCUMENTS

| | | | | |
|---|---|---|---|---|
| 7,567,764 | B2 | 7/2009 | Yamanaka et al. | |
| 9,454,105 | B1 * | 9/2016 | Onishi | G03G 15/0935 |
| 2018/0024483 | A1 * | 1/2018 | Kato | G03G 15/0865 399/94 |
| 2018/0329344 | A1 * | 11/2018 | Tamaki | G03G 15/50 |

* cited by examiner

*Primary Examiner* — Sandra Brase
(74) *Attorney, Agent, or Firm* — Foley & Lardner LLP

(57) ABSTRACT

An image forming apparatus includes a developing system, a drum, and a processor. The developing system includes a developing sleeve that is rotatable in a forward direction and a reverse direction and rotates in the forward direction to cause a developer toner filled in a container to adhere to a surface, and a blade that removes a part of the developer toner adhered to the surface of the developing sleeve. The drum receives a toner contained in the developer on the surface of the developing sleeve, and forms a toner image on a transfer belt used to transfer the toner image to the printing medium. The processor recognizes a temperature of the developing system when an operation of the developing system is stopped, determines a reverse rotation amount of the developing sleeve based on the recognized temperature, and reversely rotates the developing sleeve based on the reverse rotation amount.

18 Claims, 5 Drawing Sheets

IMAGE FORMING APPARATUS AND CONTROL METHOD OF IMAGE FORMING APPARATUS

FIELD

Embodiments described herein relate to an image forming apparatus, and a control method of an image forming apparatus.

BACKGROUND

An image forming apparatus includes a process unit that forms a toner image on a transfer belt. The image forming apparatus includes, for example, a process unit for each color. The process unit causes charging of a photoconductive drum and irradiates the photoconductive drum with light corresponding to an image data (print data) for printing, thereby forming an electrostatic latent image (electrostatic latent image) on the photoconductive drum. The process unit causes a toner to adhere to the latent image formed on the photoconductive drum using the developing unit. A transfer device transfers the toner adhered to the latent image on the photoconductive drum to the transfer belt. The image forming apparatus transfers the toner image on the transfer belt to the printing medium, presses the printing medium against a fixing roller of a high temperature, and fixes the toner image formed on the printing medium.

The developing unit includes a developing sleeve, a doctor blade, and a developer container. The developing sleeve rotates in the developer container which contains a developer containing a toner and a carrier, thereby causing the toner to adhere to the photoconductive drum. The doctor blade is a member disposed at a predetermined distance from the developing sleeve. The doctor blade removes some of the developer adhered to the surface of the developing sleeve when the developing sleeve rotates. Thus, a layer of the developer having a thickness corresponding to the distance between the doctor blade and the developing sleeve is formed on the developing sleeve. In this way, the doctor blade adjusts the thickness of the layer of the developer formed on the developing sleeve.

By heat generated in the image forming apparatus, the developer may be often solidified after being melted in the developing unit. For example, the developer adhered to the doctor blade is solidified after being melted, and thus the solidified developer may stick to the doctor blade. When the developer sticks to the doctor blade, the thickness of the layer of the developer formed on the developing sleeve may not be stabilized, and image defects may occur.

DETAILED DESCRIPTION

At least one exemplary embodiment provides an image forming apparatus and a control method of an image forming apparatus capable of preventing deterioration of image quality are provided.

In general, according to at least one embodiment, an image forming apparatus includes a developing unit (developing system), a drum, and a processor. The developing unit includes a developing sleeve that is rotatable in a forward direction and a reverse direction and rotates in the forward direction to cause a developer toner filled in a container to adhere to a surface and a blade that removes a part of the developer toner adhered to the surface of the developing sleeve. The drum receives a toner contained in the developer on the surface of the developing sleeve, and forms a toner image on a transfer belt used to transfer the toner image to the printing medium. The processor recognizes a temperature of the developing unit when an operation of the developing unit is stopped, determines a reverse rotation amount of the developing sleeve based on the recognized temperature, and reversely rotates the developing sleeve based on the reverse rotation amount.

An image forming apparatus and a control method of an image forming apparatus according to at least one embodiment will be described with reference to the drawings.

Figure 1:
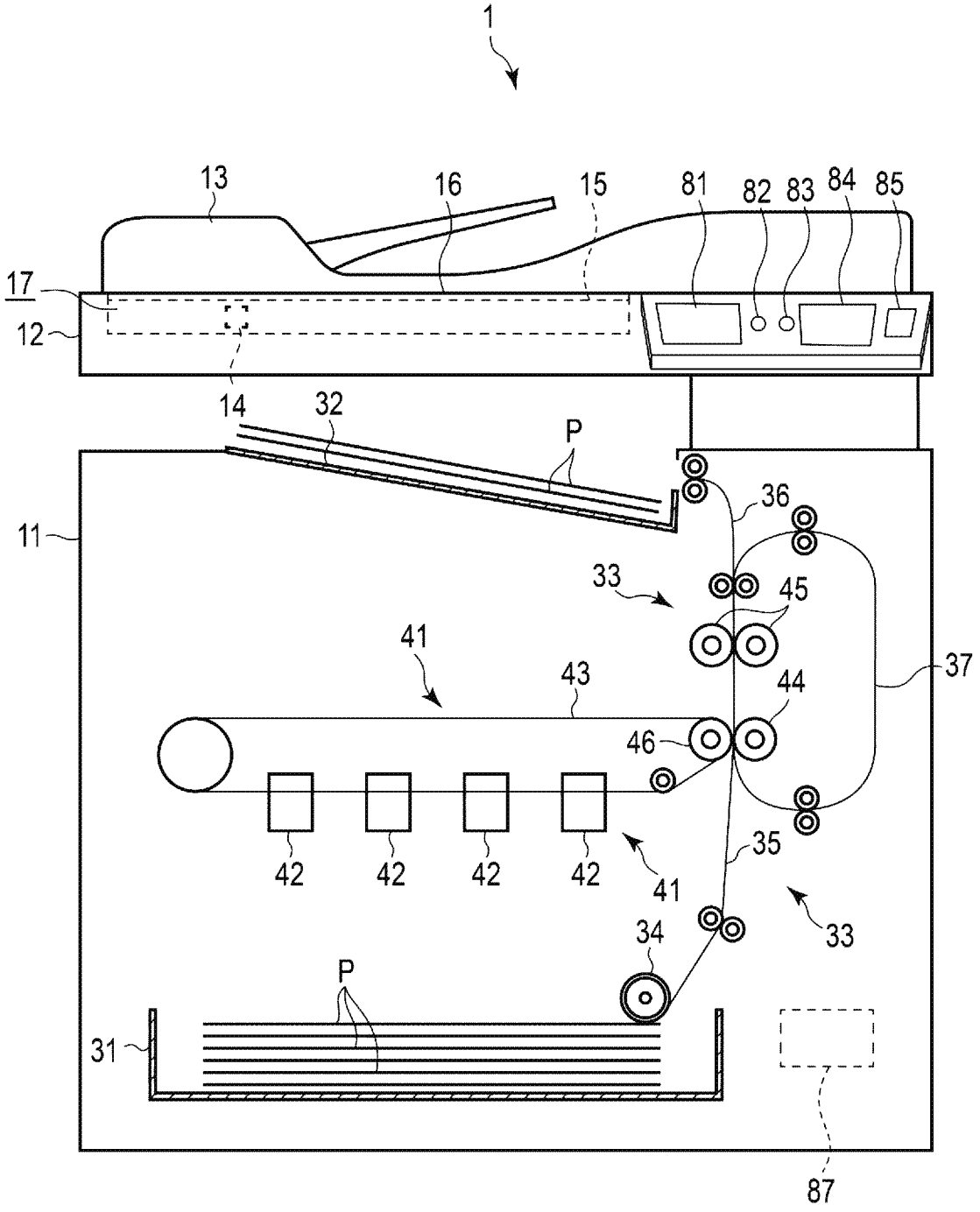
FIG. 1 is a diagram illustrating a configuration example of an image forming apparatus according to at least one embodiment.

FIG. 1 is an explanatory diagram illustrating a configuration example of an image forming apparatus 1 according to at least one embodiment.

The image forming apparatus 1 is a multifunction printer (MFP) that performs various processes such as image formation while conveying a recording medium such as a printing medium. The image forming apparatus 1 is a solid-state scanning type printer (for example, an LED printer) that scans an LED array to perform various processes such as image formation while conveying a recording medium such as a printing medium.

The image forming apparatus 1 causes charging of a photoconductive drum and irradiates the photoconductive drum with light corresponding to an image data (print data) for printing, thereby forming an electrostatic latent image on the photoconductive drum. The image forming apparatus 1 attaches a toner to the latent image formed on the photoconductive drum, transfers the toner attached to the latent image to the printing medium, and forms a toner image on the printing medium. Further, the image forming apparatus 1 sandwiches the printing medium, on which the toner image is formed, between fixing rollers heated to a high temperature by a heater, and fixes the toner image formed on the printing medium.

Further, the image forming apparatus 1 forms reflected light of the light, which is irradiated on the printing medium, on an image sensor, reads out electric charges accumulated in the image sensor, and converts the read charges into a digital signal, thereby acquiring an image on the printing medium.

As illustrated in FIG. 1, the image forming apparatus 1 includes a housing 11, an image reading system, a conveyance system, an image forming system, a control system, various interfaces, and the like. The housing 11 is a main body that holds components of the image forming apparatus 1.

First, the image reading system of the image forming apparatus 1 will be described.

As illustrated in FIG. 1, the image forming apparatus 1 includes a document table 12, an automatic document feeder (ADF) 13, and a scanner unit 14 which are respectively configured to read an image from a document.

The document table 12 is a portion on which a printing medium P as a document is placed. The document table 12 includes a glass plate 15 on which the printing medium P as a document is placed and a space 17 located on a side opposite to a placement surface 16 of the glass plate 15 on which the printing medium P as the document is placed.

The ADF 13 is a mechanism that conveys the printing medium P. The ADF 13 is provided on the document table 12 so as to be freely opened and closed. The ADF 13 takes in the printing medium P placed on a tray under the control of a system controller 87, and conveys the taken-in printing medium P while closely contacting it with the glass plate 15 of the document table 12.

The scanner unit 14 acquires an image from the printing medium P under the control of the system controller 87. The scanner unit 14 is disposed in the space 17 located on the side opposite to the placement surface 16 of the document table 12. The scanner unit 14 includes an image sensor, an optical element, lighting, and the like.

The image sensor is an imaging element in which pixels for converting light into an electric signal (image signal) are arranged in a line shape. The image sensor is made up of, for example, a charge coupled device (CCD), a complementary metal oxide semiconductor (CMOS), or another imaging element.

The optical element focuses light from a predetermined reading range on the pixels of the image sensor. The reading range of the optical element is a line-shaped region on the placement surface 16 of the document table 12. The optical element focuses light reflected by the printing medium P placed on the placement surface 16 of the document table 12 and transmitted through the glass plate 15 on the pixels of the image sensor.

The lighting irradiates the printing medium P with light. The lighting includes a light source and a light guide body that irradiates the printing medium P with light emitted from the light source. The lighting irradiates, using the light guide body, a region including the reading range of the optical element with the light emitted from the light source.

When the printing medium P is placed on the placement surface 16 of the document table 12, the scanner unit 14 is driven by a driving mechanism (not illustrated) in a sub scanning direction orthogonal to the arrangement direction (main scanning direction) of the pixels of the image sensor and parallel to the placement surface 16. The scanner unit 14 is driven in the sub scanning direction and continuously acquires an image line byline using the image sensor, thereby acquiring the entire image data (document image data) of the printing medium P placed on the placement surface 16 of the document table 12.

When the printing medium P is being conveyed by the ADF 13, the scanner unit 14 is driven to a position facing a position where the printing medium. P is brought into close contact with the ADF 13. The scanner unit 14 continuously acquires, using the image sensor, an image line by line from the printing medium P conveyed by the ADF 13, thereby acquiring the entire image data (document image data) of the printing medium P conveyed by the ADF 13.

The conveyance system of the image forming apparatus 1 will be described below.

As illustrated in FIG. 1, the image forming apparatus 1 includes, as a configuration of the conveyance system, a paper feed cassette 31, paper discharge tray 32, and a conveyance unit 33.

The paper feed cassette 31 is a cassette that accommodates the printing medium P. The paper feed cassette 31 is configured to be capable of supplying the printing medium P from the outside of the housing 11. For example, the paper feed cassette 31 can be taken out of the housing 11.

The paper discharge tray 32 is a tray that supports the printing medium P discharged from the image forming apparatus 1.

The conveyance unit 33 conveys the printing medium P. The conveyance unit 33 includes a conveyance path including a plurality of guides and a plurality of roller and a sensor that detects a conveyance position of the printing medium P due to the conveyance path. The conveyance path is a path along which the printing medium P is conveyed. The conveyance roller is rotated by a motor that operates based on the control of the system controller 87, thereby conveying the printing medium P along the conveyance path. Further, some of the plurality of guides is rotated by the motor that operates based on the control of the system controller 87, thereby switching the conveyance path along which the printing medium P is conveyed.

For example, as illustrated in FIG. 1, the conveyance unit 33 includes a take-in roller 34, a paper feed conveyance path 35, a paper discharge conveyance path 36, and a reverse conveyance path 37.

The take-in roller 34 takes the printing medium P accommodated in the paper feed cassette 31 into the paper feed conveyance path 35.

The paper feed conveyance path 35 is a conveyance path used for conveying the printing medium P, which is taken from the paper feed cassette 31 by the take-in roller 34, to the image forming unit 41.

The paper discharge conveyance path 36 is a conveyance path for discharging the printing medium P, on which an image is formed by the image forming unit 41, from the housing 11. The printing medium P discharged through the paper discharge conveyance path 36 is discharged to the paper discharge tray 32.

The reverse conveyance path 37 is a conveyance path for feeding the printing medium P in the state in which the front/back and the front/rear of the printing medium P, on which the image is formed by the image forming unit 41 are reversed, to the image forming unit 41 again.

The image forming system of the image forming apparatus 1 will be described below.

As illustrated in FIG. 1, the image forming apparatus 1 includes, as a configuration of the image forming system, the image forming unit 41.

The image forming unit 41 forms an image on the printing medium P based on the control of the system controller 87. The image forming unit 41 includes a plurality of process units 42, a transfer belt 43, a transfer roller 44, and a fixing roller 45. For example, the image forming unit 41 includes the process units 42 for different colors such as cyan, magenta, yellow, and black.

Figure 2:
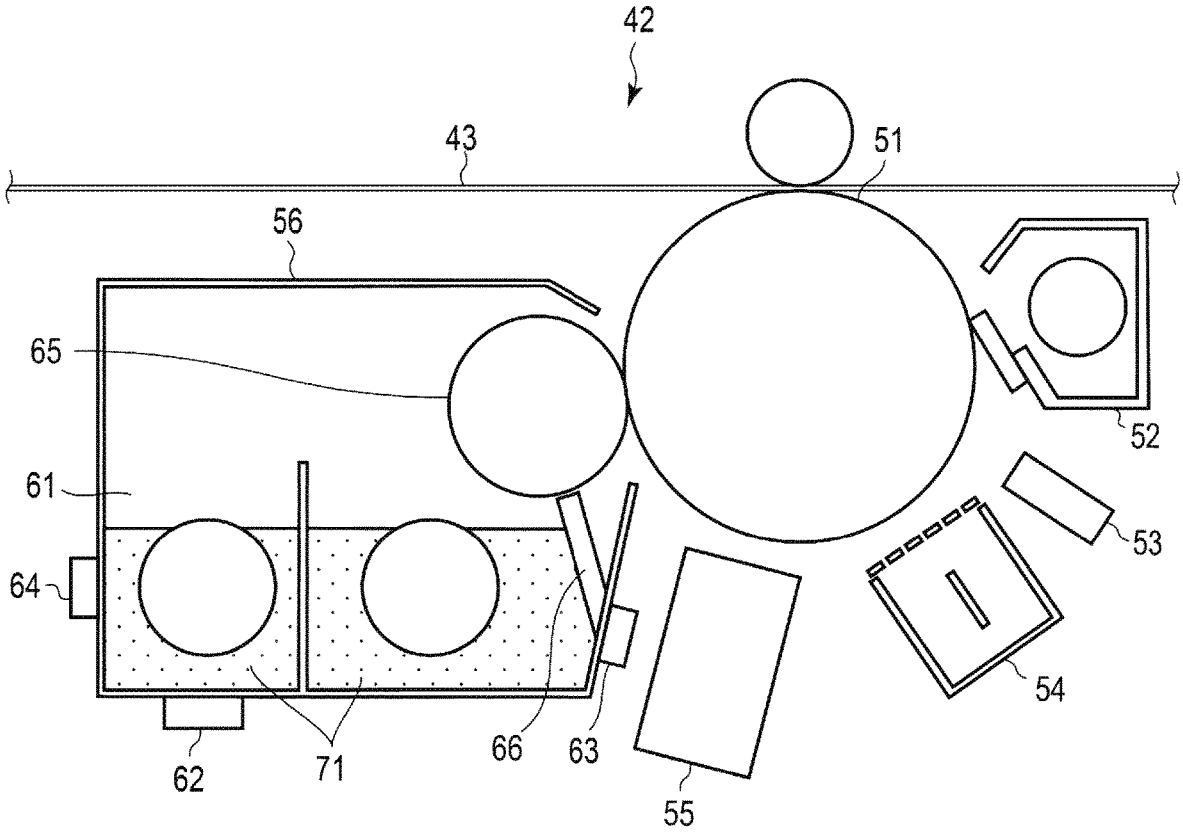
FIG. 2 is a diagram illustrating a configuration example of a process unit.

FIG. 2 is an explanatory diagram for describing a configuration of one of the plurality of process units 42. Since the respective process units 42 have the same configuration, one process unit will be described as a representative. The process unit 42 is a unit for forming a toner image, which is used for forming an image on the printing medium P, on the transfer belt 43. As illustrated in FIG. 2, the process unit 42 includes a drum 51, a cleaner 52, a static eliminator 53, an electrostatic charger 54, an exposure unit 55, and a developing unit 56 (developing system).

The drum 51 is a cylindrical photoconductive drum. The drum 51 is provided so as to be in contact with the transfer belt 43. The drum 51 is rotated at a constant speed by a driving mechanism (not illustrated).

The cleaner 52 removes a toner remaining on the drum 51 using a blade in contact with the drum 51.

The static eliminator 53 removes static electricity remaining on the drum 51. The static eliminator 53, for example, irradiates the drum 51 with light, thereby releasing static electricity using the nature that electricity easily passes through the photoconductive layer of the drum 51.

The electrostatic charger 54 uniformly charges the surface of the drum 51.

The exposure unit 55 forms an electrostatic latent image on the charged drum 51. The exposure unit 55 irradiates, based on the print data, the surface of the drum 51 with a laser beam using a light emitting element or the like, thereby forming the electrostatic latent image on the surface of the drum 51.

The developing unit 56 is a unit for forming a toner image corresponding to the print data on the transfer belt 43. The developing unit 56 includes a developer container 61, a toner concentration detecting sensor 62, a temperature sensor 63, a history memory 64, a developing sleeve 65, and a doctor blade 66.

The developer container 61 is a container for accommodating a developer 71 received from a toner cartridge filled with the developer 71 containing a toner and a carrier. An agitation mechanism (not illustrated) is provided in the developer container 61. The agitation mechanism agitates the developer 71 to maintain a state of the developer 71.

The toner cartridge for supplying the developer 71 to the developer container 61 includes an accommodation container filled with the developer 71. The toner cartridge includes a feeding mechanism for feeding the developer 71 in the accommodation container to the developer container 61. The feeding mechanism is a screw that feeds the developer 71 by rotation. The toner cartridge supplies the developer 71 to the developer container 61 when the feeding mechanism is operated in a state where the accommodation container is connected to the developer container 61.

In the accommodation container of the toner cartridge, the respective process units 42 are filled with the developers 71 having different toner colors. For example, a toner cartridge filled with the developer 71 containing a cyan toner is connected to the process unit 42 corresponding to cyan. A toner cartridge filled with the developer 71 containing a magenta toner is connected to the process unit 42 corresponding to magenta. A toner cartridge filled with the developer 71 containing a yellow toner is connected to the process unit 42 corresponding to yellow. A toner cartridge filled with the developer 71 containing a black toner is connected to the process unit 42 corresponding to black.

The toner concentration detecting sensor 62 detects a concentration of the toner in the developer container 61. The output of the toner concentration detecting sensor 62 varies depending on the concentration of the toner in the developer container 61. The toner concentration detecting sensor 62 supplies the detection result to the system controller 87.

The temperature sensor 63 detects a temperature of the developing unit 56. For example, the temperature sensor 63 detects a temperature outside of the developer container 61 in the developing unit 56. Further, the temperature sensor 63 may be configured to detect a temperature of the doctor blade 66 in the developing unit 56. The temperature sensor 63 supplies the detection result to the history memory 64. The temperature sensor 63 may be provided in the vicinity of the developing unit 56 instead of being provided in the developing unit 56. That is, the temperature sensor 63 may be provided at a position where the change in the temperature of the developing unit 56 can be detected.

The history memory 64 stores various types of history information. The history information is, for example, the detection result of the temperature sensor 63 every time. That is, the history information is information indicating the change in the temperature of the developing unit 56 depending on the time. For example, the history memory 64 acquires the detection result of the temperature from the temperature sensor 63, and stores, as history information, the detection result in correlation with a time stamp. The history memory 64 resets the history information of the temperature when the developer 71 of the developer container 61 is exchanged, for example.

The developing sleeve 65 rotates in the developer container 61 to cause the toner to adhere to the drum 51. The developing sleeve 65 is, for example, a cylindrical member in which a magnet is incorporated. The developing sleeve 65 is configured to be rotatable in both the forward direction and the reverse direction. The forward direction is a direction opposite to the rotation direction of the drum 51. The reverse direction is the same direction as the rotation direction of the drum 51. The developing sleeve 65 rotates in the forward direction in the developer container 61, thereby conveying the developer 71 in the developer container 61 onto the sleeve and causing the toner contained in the developer 71 to adhere to the latent image of the drum 51. The developing sleeve 65 rotates in the forward direction in a state where the developer layer is in contact with the surface of the drum 51, thereby causing the toner contained in the developer 71 adhered to the surface of the developing sleeve 65 to adhere to the latent image of the drum 51.

The doctor blade 66 is a member disposed at a predetermined distance from the developing sleeve 65. The doctor blade 66 removes some of the developer 71 adhered to the surface of the developing sleeve 65 when the developing sleeve 65 rotates. Thus, a layer of the developer 71 having a thickness corresponding to the distance between the doctor blade 66 and the developing sleeve 65 is formed on the surface of the developing sleeve 65. In this way, the doctor blade 66 adjusts the thickness of the layer of the developer 71 formed on the developing sleeve 65.

In the configuration described above, when the developer layer, which is removed by the doctor blade 66 and is formed with a certain thickness on the surface of the developing sleeve 65, comes in contact with the surface of the drum 51, the toner contained in the developer adheres to the latent image formed on the surface of the drum 51. Thus, the toner image is formed on the surface of the drum 51. The toner image formed on the surface of the drum 51 is transferred to the transfer belt 43.

The transfer belt 43 is a member that is used to receive the toner image from the drum 51 and to transfer the received toner image to the printing medium P. The transfer belt 43 is wound around a counter roller 46, which faces the transfer roller 44, and a plurality of winding rollers. The transfer belt 43 moves by rotation of the counter roller 46 and the plurality of winding rollers. The transfer belt 43 receives the toner image formed on the drum 51 at the position in contact with the drum 51. Further, the transfer belt 43 carries the received toner image to a nip (transfer nip), in which the counter roller 46 and the transfer roller 44 are in close contact with each other, via the transfer belt 43.

The transfer roller 44 presses the printing medium P passing through the transfer nip against the counter roller 46 via the transfer belt 43. Thus, the toner image formed on the transfer belt 43 is transferred to the printing medium P passing through the transfer nip.

The pair of fixing rollers 45 are configured to sandwich the printing medium P therebetween. One (heat roller) of the pair of fixing rollers 45 is heated by a heater (not illustrated). The other (press roller) of the pair of fixing rollers 45 presses the printing medium P against the heat roller. That is, the pair of fixing rollers 45 applies pressure while applying heat to the printing medium P. Thus, the pair of fixing rollers 45 fix the toner image transferred onto the printing medium P. As a result, an image is formed on the printing medium P.

The control system of the image forming apparatus 1 will be described below.

Figure 3:
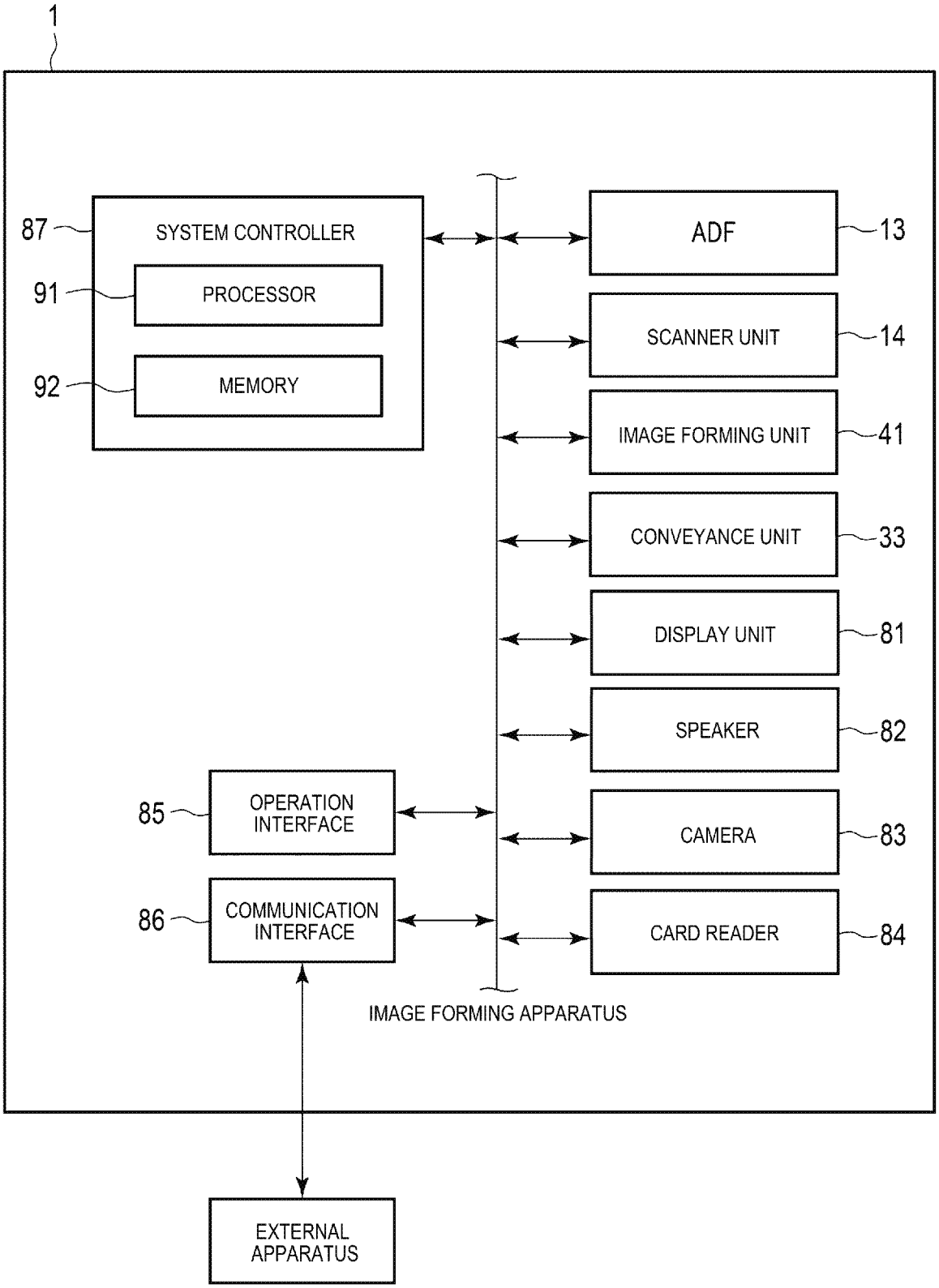
FIG. 3 is a diagram illustrating a configuration example of a control system and various interfaces.

As illustrated in FIG. 3, the image forming apparatus 1 includes, as a configuration of the control system and various interfaces, a display unit 81, a speaker 82, a camera 83, a card reader 84, an operation interface 85, a communication interface 86, and a system controller 87.

The display unit 81 includes a display on which a screen is displayed according to a video signal input from the system controller 87 or a display control unit (not illustrated) such as a graphic controller. For example, on the display of the display unit 81, a screen for various settings of the image forming apparatus 1 is displayed.

The speaker 82 outputs a voice according to a voice signal input from the system controller 87. For example, the speaker 82 outputs an alert to a user, who operates the image forming apparatus 1, as a voice.

The camera 83 acquires a facial picture of a person who operates the image forming apparatus 1. The camera 83 captures a range in which the face of the user who operates the image forming apparatus 1 is supposed to appear within a predetermined range in the vicinity of the image forming apparatus 1, and acquires a facial picture.

The card reader 84 is an interface for communicating with an IC card possessed by the user of the image forming apparatus 1. The card reader 84 transmits and receives data to and from the IC card by contact communication or non-contact communication.

The IC card includes an IC chip and a circuit for communication. The IC chip includes a CPU, a ROM, a RAM, a non-volatile memory, and the like. The non-volatile memory of the IC chip includes identification information indicating the user possessing the IC card. The circuit for communication is configured as, for example, an antenna or contact terminals (contact patterns). The circuit for communication is electrically or magnetically connected to the card reader 84.

The card reader 84 acquires identification information indicating the user possessing the IC card by communicating with the IC card.

The operation interface 85 is connected to an operation member (not illustrated). The operation interface 85 supplies an operation signal corresponding to an operation of the operation member to the system controller 87. The operation member is, for example, a touch sensor, a ten key, a power button, a paper feed key, various function keys, or a keyboard. The touch sensor is, for example, a resistive touch sensor or a capacitive touch sensor. The touch sensor acquires information indicating a designated position within a certain area. The touch sensor can be configured as a touch panel integrated with the display unit 81 to input a signal indicating a touched position on a screen displayed on the display unit 81 to the system controller 87.

The communication interface 86 is an interface for communicating with other devices. The communication interface 86 is used for communication with, for example, a host device that transmits print data to the image forming apparatus 1. The communication interface 86 is configured as, for example, a LAN connector. Further, the communication interface 86 may perform wireless communication with other devices according to standards such as Bluetooth (registered trademark) or Wi-fi (registered trademark).

The system controller 87 controls the image forming apparatus 1. The system controller 87 includes, for example, a processor 91 and a memory 92.

The processor 91 is an arithmetic element (for example, a CPU) that executes arithmetic processes. The processor 91 performs various processes based on data such as a program stored in the memory 92. The processor 91 functions as a control unit capable of executing various operations by executing the program stored in the memory 92.

The memory 92 is a storage medium that stores a program and data used by the program. The memory 92 also functions as a working memory. That is, the memory 92 temporarily stores data being processed by the processor 91 and a program or the like being executed by the processor 91.

In addition, the system controller 87 is connected to, via buses, the ADF 13, the scanner unit 14, the conveyance unit 33, the image forming unit 41, the display unit 81, the speaker 82, the camera 83, the card reader 84, the operation interface 85, and the communication interface 86, for example.

Various processes performed by the processor 91 will be described below.

The processor 91 functions as an acquisition unit that acquires the print data for forming an image on the printing medium P by executing the program stored in the memory 92. For example, the processor 91 receives the print data from an external apparatus via the communication interface 86. Further, the processor 91 may be configured to generate print data based on the image acquired by the scanner unit 14.

The print data may be data for forming an image on one printing medium P, or data for forming an image on a plurality of printing media P. Further, the print data may include designation of the number of printing (the number of copies) for the same contents.

In addition, the processor 91 executes the program stored in the memory 92, thereby executing a printing process of forming an image corresponding to the print data on the printing medium P using the image forming unit 41. For example, the processor 91 operates the respective process units 42 of the image forming unit 41 based on the print data and inputs a conveyance control signal instructing the conveyance of the printing medium P to the conveyance unit 33, thereby forming an image on the surface of the printing medium P while conveying the printing medium P.

The processor 91 executes the program stored in the memory 92 to control the operation of supplying the developer to the developing unit 56 from the toner cartridge attached to a loading unit of the process unit 42. That is, the processor 91 controls the operation of the developer supply motor of the loading unit of the process unit 42.

Further, the processor 91 executes the program stored in the memory 92 to execute a reverse rotation process of reversely rotating the developing sleeve 65 of the developing unit 56. That is, the reverse rotation process is a process in which the developing sleeve 65 rotates in a direction opposite to the rotation direction at the time of supplying the toner to the drum 51.

Figure 4:
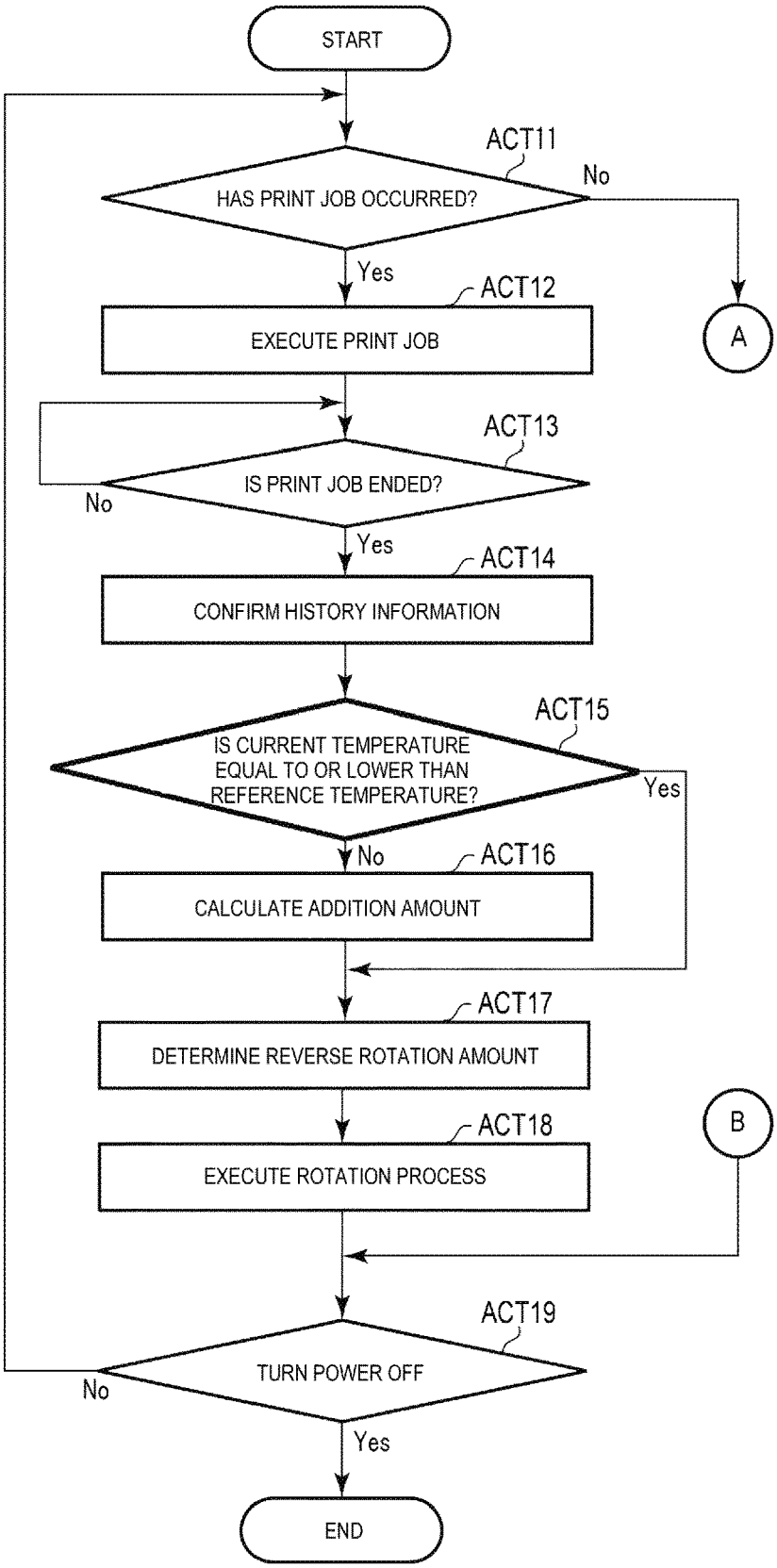
FIG. 4 is a flowchart illustrating a process of a processor when the image forming apparatus performs a reverse rotation process.
Figure 5:
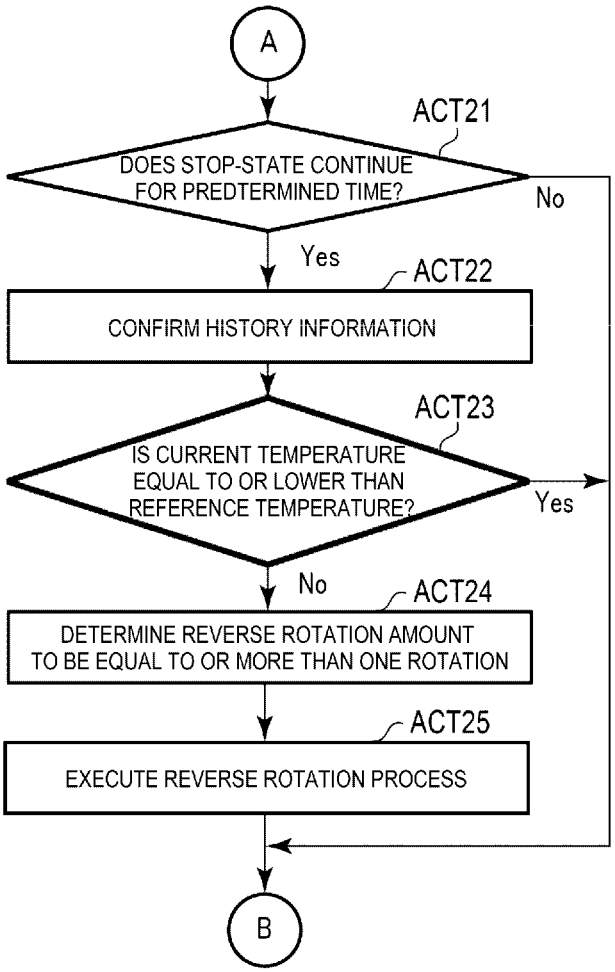
FIG. 5 is a flowchart illustrating a process of a processor when the image forming apparatus performs a reverse rotation process.

FIGS. 4 and 5 are flowcharts of a process when the processor 91 executes the reverse rotation process. The processor 91 executes the process of FIG. 4 for each process unit 42.

When the power supply is turned on, power is supplied to the respective components of the image forming apparatus 1 from a power-supply circuit (not illustrated), the fixing roller 45 of the image forming unit 41 is heated by the heater, and thus the image forming apparatus 1 enters into a state (ready state) in which printing can be performed. In the ready state, the processor 91 generates a print job when acquiring an image using the scanner unit 14 or receiving the print data received through the communication interface 86.

The processor 91 determines whether the print job has occurred (ACT11). The processor 91 executes the print job (ACT12) when determining that the print job has occurred (ACT11, YES). That is, the processor 91 controls the conveyance unit 33, the image forming unit 41, and the like based on the print job which has occurred, thereby forming an image on the printing medium P.

The processor 91 determines whether the print job is ended (ACT13). That is, the processor 91 determines whether the operation of the developing unit 56 in the process unit 42 for executing the print of the image forming unit 41 is stopped. The processor 91 repeatedly executes the determination of ACT13.

When determining that the print job is ended (ACT13, YES), that is, when determining that the developing unit 56 of the process unit 42 is stopped from the operating state, the processor 91 confirms history information stored in the history memory 64 of the developing unit 56 in the process unit 42 (ACT14). That is, the processor 91 recognizes a temperature in the close vicinity of the developing unit 56 when the operation of the developing unit 56 is stopped.

The processor 91 determines, based on the history information, that the current temperature is equal to or lower than the preset reference temperature (ACT15). That is, the processor 91 determines whether the temperature in the close vicinity of the developing unit 56 recognized from the history information is equal to or lower than the reference temperature.

The processor 91 determines a reverse rotation amount of the developing sleeve 65 based on the recognized temperature in the close vicinity of the developing unit 56 and the preset reference temperature.

Specifically, when determining that the current temperature is not equal to or lower than the preset reference temperature (ACT15, NO), the processor 91 calculates an addition amount of the reverse rotation amount of the developing sleeve 65 based on the difference between the recognized temperature in the close vicinity of the developing unit 56 and the preset reference temperature (ACT16). In this case, the processor 91 determines a value obtained by adding the addition amount calculated in ACT16 to the preset reference reverse rotation amount, as a reverse rotation amount (ACT17). That is, the processor 91 increases the reverse rotation amount with respect to the reference reverse rotation amount based on the temperature of the developing unit 56 and the reference temperature.

When determining that the current temperature is equal to or lower than the preset reference temperature (ACT15, YES), the processor 91 causes the process to proceed to ACT17. In this case, the processor 91 determines the preset reference reverse rotation amount as a reverse rotation amount (ACT17).

The processor 91 executes a reverse rotation process of reversely rotating the developing sleeve 65 based on the determined reverse rotation amount (ACT18). Thus, the developer remaining in the vicinity of the doctor blade 66 is returned to the agitation mechanism side of the developer container 61 of developing unit 56. Accordingly, heat is prevented from being applied to the developer in a state where the developer remains in the vicinity of the doctor blade 66.

The processor 91 determines whether the power supply of the image forming apparatus 1 is turned off (ACT19). When determining that the power supply of the image forming apparatus 1 is turned off (ACT19, YES), the processor 91 stops the supply of power from the power-supply circuit and ends the process of FIG. 4. When the power supply of the image forming apparatus 1 is not turned off (ACT19, NO), the processor 91 causes the process to proceed to ACT11, and repeatedly executes the processes of ACT11 to ACT19.

Further, the processor 91 executes the reverse rotation process of reversely rotating the developing sleeve 65 of the developing unit 56 even when the developing unit 56 is kept in the stop state and the developing unit 56 is at a high temperature. For example, when determining that no print job has occurred in ACT11 (ACT11, NO), the processor 91 causes the process to proceed to a process ACT21 in FIG. 5. The processor 91 determines in ACT21 whether the stop-state of the developing unit 56 of the process unit 42 continues for a predetermined time (ACT21).

When determining that the stop-state of the developing unit 56 of the process unit 42 does not continue for the predetermined time (ACT21, NO), the processor 91 causes the process to proceed to ACT19 in FIG. 4.

When determining that the stop-state of the developing unit 56 of the process unit 42 continues for the predetermined time (ACT21, YES), the processor 91 confirms the history information stored in the memory 64 of the developing unit 56 in the process unit 42 (ACT22). Thus, the processor 91 recognizes the temperature in the close vicinity of the developing unit 56.

The processor 91 determines, based on the history information, that the current temperature is equal to or lower than the preset reference temperature (ACT23). That is, the processor 91 determines whether the temperature in the close vicinity of the developing unit 56 recognized from the history information is equal to or lower than the reference temperature.

When determining that the current temperature is equal to or lower than the preset reference temperature (ACT23, YES), the processor 91 causes the process to proceed to ACT19 in FIG. 4.

When determining that the current temperature is not equal to or lower than the preset reference temperature (ACT23, NO), the processor 91 determines the reverse rotation amount of the developing sleeve 65 to be equal to or more than one rotation (ACT24).

The processor 91 executes a reverse rotation process of reversely rotating the developing sleeve 65 based on the determined reverse rotation amount (ACT25), and causes the process to proceed to ACT19 in FIG. 4. Thus, the developer remaining in the vicinity of the doctor blade 66 is returned to the agitation mechanism side of the developer container 61 of developing unit 56. Accordingly, in the developing unit 56 in which the stop state continues, heat is prevented from being applied to the developer in a state where the developer remains in the vicinity of the doctor blade 66.

When performing the reverse rotation process on the developing sleeve 65, the processor 91 may be configured to reset the history memory 64 of the developing unit 56 provided with the developing sleeve 65 subjected to the reverse rotation process.

As described above, the image forming apparatus 1 includes the developing unit 56 that forms the toner image on the drum 51 and the processor 91 that controls the operation of the developing unit 56. The developing unit 56 includes the developing sleeve 65 that is rotatable in the forward direction or the reverse direction and rotates in the forward direction to cause the developer in the developer container 61 to adhere to the surface thereof and the doctor blade 66 that removes some of the developer adhered to the surface of the developing sleeve 65. The drum 51 receives the toner contained in the developer on the surface of the developing sleeve 65, and forms the toner image on the transfer belt 43. When the operation of the developing unit 56 is stopped, the processor recognizes the temperature of the developing unit 56, and determines the reverse rotation amount of the developing sleeve 65 based on the recognized temperature and the preset reference temperature. The processor 91 reversely rotates the developing sleeve 65 based on the determined reverse rotation amount. Accordingly, it is possible to prevent the developer from sticking to the doctor blade 66.

In addition, when the recognized temperature is lower than the reference temperature, the processor 91 reversely rotates the developing sleeve 65 based on the preset reference reverse rotation amount. Further, when the recognized temperature is higher than the reference temperature, the processor 91 calculates the addition amount based on the difference between the recognized temperature and the reference temperature, and reversely rotates the developing sleeve 65 based on the value obtained by adding the addition amount to the preset reference reverse rotation amount. In this way, when the developing unit 56 is at a high temperature, it is possible to reduce the possibility that the developer sticks to the doctor blade 66 by the increase in the reverse rotation amount.

Further, when the developing unit 56 is in the stop state for the predetermined time or longer and the temperature of the developing unit 56 is higher than the reference temperature, the processor 91 reversely rotates the developing sleeve 65 by one or more rotations. This makes it possible to reduce the possibility that the developer sticks to the doctor blade 66 in the developing unit 56 in which the stop state continues. For example, the processor 91 causes the developing sleeve 65 to reversely rotate more than one rotation when the temperature of the developing unit 56 is higher than the reference temperature at the time of turning-OFF of the image forming apparatus 1.

Further, the processor 91 puts the image forming apparatus 1 into a sleep state, for example, based on predetermined conditions. The sleep state is a state in which power is supplied only to a part of the configuration of the system controller 87 of the image forming apparatus 1 and the power is not supplied to other configurations. The sleep state is a state in which the power is not supplied to at least the conveyance unit 33 and the image forming unit 41. The processor 91 shifts the image forming apparatus 1 to the sleep state when the print job does not continuously occur for a predetermined time. For example, the processor 91 may cause the developing sleeve 65 to reversely rotate more than one rotation at the time of shifting the image forming apparatus 1 to the sleep state when the temperature of the developing unit 56 is higher than the reference temperature.

In the example described above, the processor 91 calculates the addition amount based on the difference between the temperature of the developing unit 56 and the reference temperature and determines the value obtained by adding the addition amount to the reference reverse rotation amount as the reverse rotation amount, but another configuration may be used. The processor 91 may be configured to determine reverse rotation amount by referring to a table stored in the memory 92, the memory 92 storing the table in which the temperature of the developing unit 56 and the magnification with respect to the addition amount or the reference reverse rotation amount are associated with each other.

In the example described above, the processor 91 causes the developing sleeve 65 to reversely rotate more than one rotation when the developing sleeve 65 of the process unit 42 is continuously stopped for a predetermined time and the temperature is higher than the reference temperature, but another configuration may be used. A predetermined amount corresponding to the configuration of the developing sleeve 65 may be set as a reverse rotation amount instead of the reverse rotation amount of one or more rotations.

In the example described above, when determining that the developing unit 56 of the process unit 42 is continuously stopped for a predetermined time, the processor 91 confirms the history information stored in the history memory 64 of the developing unit 56 in the process unit 42 and determines whether to perform the reverse rotation process, but another configuration may be used. The processor 91 may confirm, at another timing, the history information stored in the history memory 64 of the developing unit 56 in the process unit 42 and determine whether to perform the reverse rotation process. For example, the processor 91 may be configured to confirm the history information stored in the history memory 64 of the developing unit 56 in the process unit 42 at predetermined intervals and to determine whether to perform the reverse rotation process. In addition, the processor 91 may be configured to confirm the history information stored in the history memory 64 of the developing unit 56 in the process unit 42 when the image forming apparatus 1 is started or is in the ready state and to determine whether to perform the reverse rotation process. Further, when operating one of the plurality of process units 42, the processor 91 may be configured to confirm the history information stored in the history memory 64 of the developing unit 56 in the process unit 42, which is not operating, and to determine whether to perform the reverse rotation process on the developing sleeve 65 of the process unit 42 which is not operating.

When the developing unit 56 of the process unit 42 is stopped and the developing unit 56 of another process unit 42 is operating, the developing unit 56 of the process unit 42 absorbs heat propagating from the driving mechanism of another process unit 42 and the fixing roller 45. Therefore, the history memory 64 of the developing unit 56 may be configured to count the time (standby time) during which the developing unit 56 provided with the history memory 64 is stopped and another developing unit 56 is operating and to store the counted time as history information. For example, when the standby time reaches a preset time, the processor 91 may be configured to confirm the history information stored in the history memory 64 of the developing unit 56 in the process unit 42 and to determine whether to perform the reverse rotation process. Further, for example, when the standby time reaches the preset time, the processor 91 may be configured to perform the reverse rotation process.

The history memory 64 of the developing unit 56 may be configured to calculate an integrated value of the reverse rotation amount of the developing sleeve 65 of another developing unit 56 and to store the integrated value as history information. For example, when the calculated integrated value reaches a preset threshold value, the processor 91 may be configured to confirm the history information stored in the history memory 64 of the developing unit 56 in the process unit 42 and to determine whether to perform the reverse rotation process. For example, when the calculated integrated value reaches the preset threshold value, the processor 91 may be configured to perform the reverse rotation process.

Further, the processor 91 may be configured to calculate the reverse rotation amount used to reversely rotate the developing sleeve 65 based on more various types of information. For example, the processor 91 acquires the history information of the detection result of the temperature from the history memory 64. Further, for example, the processor 91 acquires the detection result of the toner concentration from the toner concentration detecting sensor 62, and estimates the amount of toner to be used. In addition, for example, the processor 91 counts the operation time for each developing unit 56. The processor 91 calculates one score for each developing unit based on a plurality of factors such as temperature history information, the amount of toner to be used, and the operation time of the developing unit 56. The processor 91 may be configured to determine the reverse rotation amount of the developing sleeve 65 based on the calculated score. Further, for example, the processor 91 may be configured to calculate the addition amount based on the calculated score and to determine, as the reverse rotation amount, the value obtained by adding the calculated addition amount to the reference reverse rotation amount.

In the embodiment described above, the history memory 64 for storing the history information is provided in the developing unit 56, but another configuration may be used. The history memory 64 may be provided at any position in the image forming apparatus 1. For example, some of the storage regions of the memory 92 in the system controller 87 may be configured to store the history information.

It is to be noted that the functions described in the embodiments can be configured using hardware, and can be realized by reading a program, in which each function is described using software, with a computer. Further, each function may be configured by selecting software or hardware as appropriate.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus that forms an image on a printing medium, comprising:

a developing system including:

a developing sleeve that is rotatable in a forward direction and a reverse direction, the developing sleeve configured to rotate in the forward direction to cause a developer contained in a container to adhere to a surface of the developing sleeve, and a blade configured to remove a part of the developer adhered to the surface of the developing sleeve;

a drum configured to receive a toner contained in the developer on the surface of the developing sleeve, and to form a toner image on a transfer belt used to transfer the toner image to the printing medium; and a processor configured to recognize a temperature of the developing system when an operation of the developing system is stopped, to determine a reverse rotation amount of the developing sleeve based on the recognized temperature, and to reversely rotate the developing sleeve based on the reverse rotation amount, wherein the processor is configured to determine a preset reference reverse rotation amount as the reverse rotation amount when the temperature of the developing system is equal to lower than a preset reference temperature.

2. The apparatus according to claim 1, wherein the processor is configured to increase the reference reverse rotation amount when the temperature of the developing unit is higher than the reference temperature.

3. The apparatus according to claim 2, wherein the processor is configured to calculate an addition amount based on the temperature of the developing system, and to determine a value obtained by adding the addition amount to the reference reverse rotation amount as the reverse rotation amount.

4. The apparatus according to claim 2, further comprising:

a history memory that stores history information indicating a change in the temperature of the developing system according to a time, wherein the processor is configured to recognize a temperature in the vicinity of the developing system based on the history information, and to determine a reverse rotation amount of the developing sleeve based on the recognized temperature and the preset reference temperature.

5. The apparatus according to claim 4, wherein the developing system includes the history memory.

6. The apparatus according to claim 5, wherein the processor determines the reverse rotation amount in part based on a toner concentration amount.

7. The apparatus according to claim 2, wherein the processor is configured to cause the developing sleeve to reversely rotate more than one rotation when the developing system is continuously stopped for a preset time or longer and the temperature of the developing system is higher than the reference temperature.

8. The apparatus according to claim 7, wherein the developing system is continuously stopped for the preset time or longer during a turn-OFF of a power source.

9. The apparatus according to claim 7, wherein the developing system is continuously stopped for the preset time or longer during a sleep state.

10. The apparatus according to claim 1, wherein the processor is configured to calculate an addition amount based on a difference between the temperature of the developing system and the reference temperature when the temperature of the developing system is higher than the reference temperature, and to determine a value obtained by adding the addition amount to the reference reverse rotation amount as the reverse rotation amount.

11. A control method of an image forming apparatus, the image forming apparatus including a developing system including a developing sleeve that is rotatable in a forward direction and a reverse direction, the developing sleeve configured to rotate in the forward direction to cause a developer contained in a container to adhere to a surface, and a blade that removes a part of the developer adhered to the surface of the developing sleeve; a drum configure to receive a toner contained in the developer on the surface of the developing sleeve, and to form a toner image on a transfer belt used to transfer the toner image to the printing medium; and a processor, the method comprising:

recognizing, via the processor, a temperature of the developing system when an operation of the developing system is stopped;

determining, via the processor, a reverse rotation amount of the developing sleeve based on the recognized temperature;

reversely rotating the developing sleeve based on the reverse rotation amount; and determining a preset reference reverse rotation amount as the reverse rotation amount when the temperature of the developing system is equal to lower than a preset reference temperature.

12. The method according to claim 11, further comprising increasing the reference reverse rotation amount when the temperature of the developing system is higher than the reference temperature.

13. The method according to claim 12, further comprising calculating an addition amount based on the temperature of the developing system; and determining a value obtained by adding the addition amount to the reference reverse rotation amount as the reverse rotation amount.

14. The method according to claim 12, further comprising:

recognizing a temperature in the vicinity of the developing system based on history information; and determining a reverse rotation amount of the developing sleeve based on the recognized temperature and the preset reference temperature, the history information indicating a change in the temperature of the developing system according to a time.

15. The method according to claim 12, further comprising:

causing the developing sleeve to reversely rotate more than one rotation when the developing system is continuously stopped for a preset time or longer and the temperature of the developing system is higher than the reference temperature.

16. The method according to claim 15, wherein the developing system is continuously stopped for the preset time or longer during a turn-OFF of a power source.

17. The apparatus according to claim 15, wherein the developing system is continuously stopped for the preset time or longer during a sleep state.

18. The method according to claim 11, further comprising:

calculating an addition amount based on a difference between the temperature of the developing system and the reference temperature when the temperature of the developing system is higher than the reference temperature, and determining a value obtained by adding the addition amount to the reference reverse rotation amount as the reverse rotation amount.

* * * * *